US005862880A

United States Patent [19]

Nelson et al.

[11] Patent Number: 5,862,880

[45] Date of Patent: Jan. 26, 1999

[54] ROOF SCAFFOLDING SYSTEM

[76] Inventors: Michael L. Nelson; Sharon L. Niles, both of 630 N. Seventh, Niles, Mich. 49120

[21] Appl. No.: 649,799

[22] Filed: May 17, 1996

[51] Int. Cl.[6] ..... E04G 3/12

[52] U.S. Cl. ..... 182/45; 248/237

[58] Field of Search ..... 182/45, 150; 248/237

[56] References Cited

U.S. PATENT DOCUMENTS

| | | | |
|---|---|---|---|
| 677,645 | 7/1901 | Elkins | 182/45 X |
| 742,565 | 10/1903 | Berry | 182/45 X |
| 1,650,324 | 11/1927 | Campbell | 182/45 X |
| 3,164,353 | 1/1965 | Rene | 248/237 |
| 3,292,734 | 12/1966 | Swanberg | 182/45 |
| 4,856,745 | 8/1989 | Mabir | 248/237 |
| 5,113,971 | 5/1992 | Violet | 182/45 |
| 5,320,194 | 6/1994 | Bredyk | 182/45 |
| 5,379,859 | 1/1995 | Pigman | 182/45 |

FOREIGN PATENT DOCUMENTS

| | | | |
|---|---|---|---|
| 1275506 | 10/1961 | France | 182/45 |
| 2199069 | 6/1988 | United Kingdom | 182/45 |

*Primary Examiner*—Alvin C. Chin-Shue
*Attorney, Agent, or Firm*—Joseph N. Breaux

[57] ABSTRACT

A roof scaffolding system of the type for use on a pitched roof that may be moved both longitudinally and laterally is provided. The roof scaffolding system includes: a peak anchor having a carrying assembly connected atop thereof, the peak anchor being adapted for connecting to a pitched roof; a side rail assembly having a base member, a top member and a load support member adapted to support an elongated scaffold member, the load support member interconnecting the base member and the top member; and an elongated flexible member operationally connecting the side rail assembly and the peak anchor in a manner such that the side rail assembly may be moved longitudinally and laterally upon a roof. The roof scaffolding system may include a cross rail member connected between to side rail assemblies to serve as a safety rail for a user. The roof scaffolding system may further include a net connectable between the side rail assemblies to prevent objects from falling from the work area.

2 Claims, 1 Drawing Sheet

FIG. 1
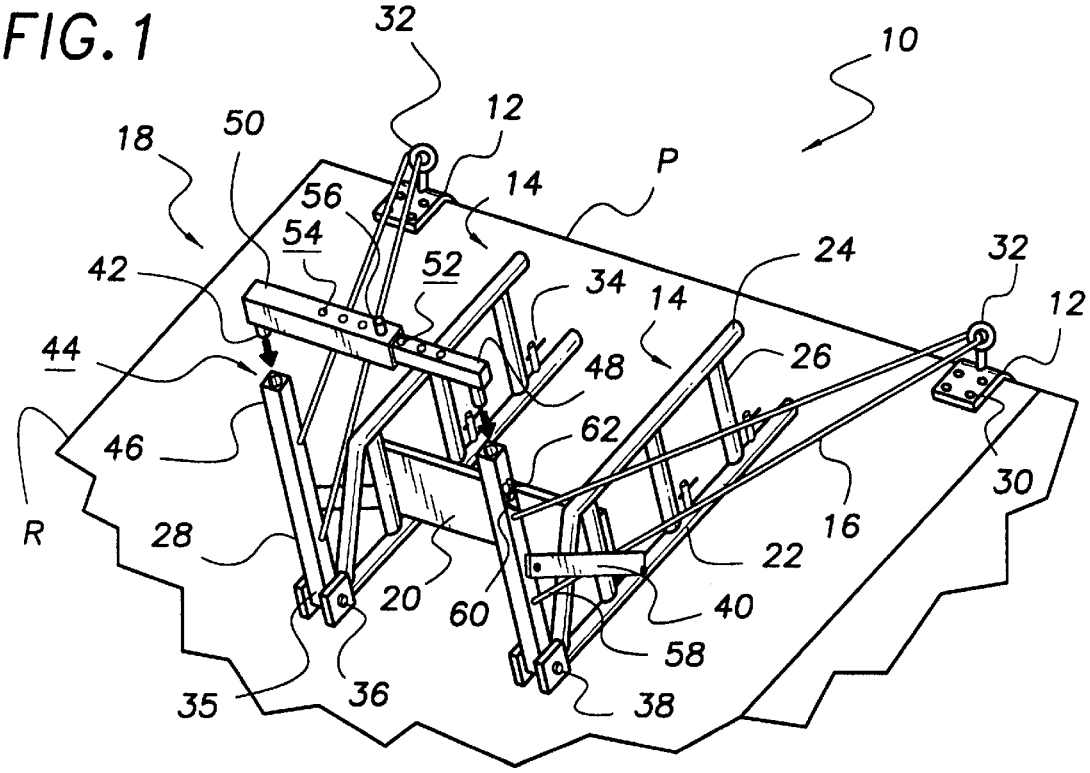
FIG. 2
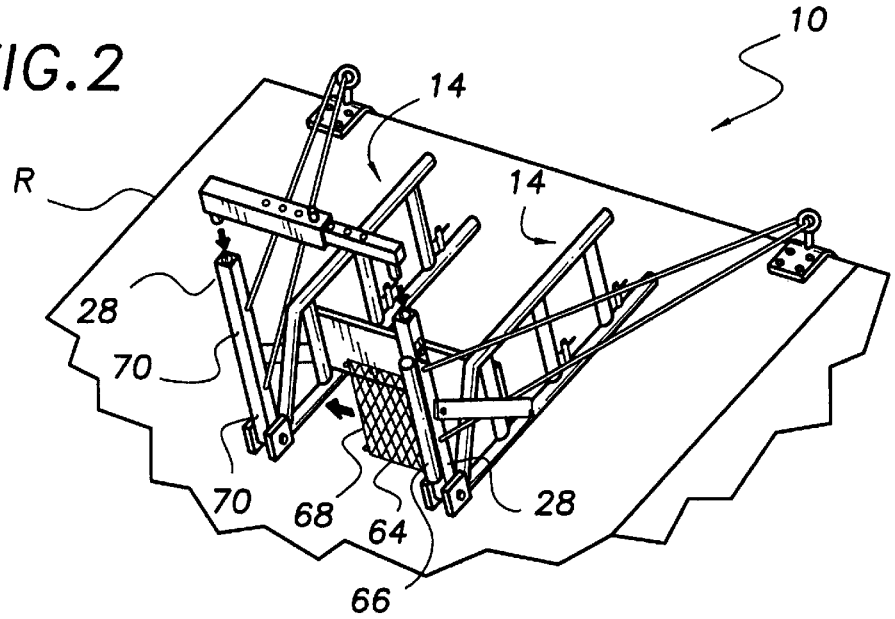
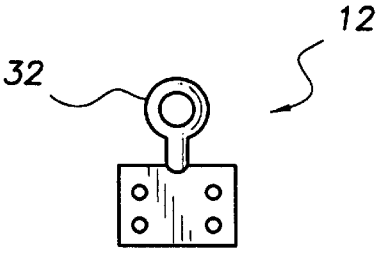
FIG. 3

ROOF SCAFFOLDING SYSTEM

TECHNICAL FIELD

The present invention relates to roof scaffolding apparatus and more particularly to roof scaffolding apparatus that are movable both longitudinally and laterally on a pitched roof.

BACKGROUND ART

As is well known, most roof surfaces generally are sufficiently steep that roofers, who must move about thereon for a variety of reasons, must be continuously alert to the danger of slipping and falling. Over the years, many roof scaffold devices have been proposed in the prior art to reduce these dangers.

However, a steep roof presents several problems for roofers which do not appear to be adequately addressed by these prior art devices. One problem is that with these devices the roofer is required to rigidly fasten the device to the roof with nails, then, when the device needs to be moved the nails are removed and the device is reattached to the roof. This process is time consuming and risks the integrity of the roof. Another problem is the safety of these devices. First, the roofer must connect the device on the pitched roof while in a precarious position, then, when the device is to be moved the roofer must repeat this process, increasing the risk of falling. In addition, the prior art devices do not provide any railing to aid the roofer while working.

It would be a benefit, therefore to have a roof scaffolding system that permits a roofer to suspend the device from a single position approximate the peak of the roof. It would be an additional benefit to have a roof scaffolding device that may be moved both longitudinally and laterally upon the roof without having to disconnect the device from the roof. It would be further benefit that provides side rails which aid the roofer in moving upon the roof. It would be a still further benefit to have a device providing a cross rail to prevent a roofer from falling from the device. It would be a still further benefit to have a device that prevents small items from falling from the work area.

GENERAL SUMMARY DISCUSSION OF INVENTION

It is thus an object of the invention to provide a roof scaffolding system that has a pair of peak anchors connectable approximate the peak of a roof each peak anchor having a carrying assembly.

It is a further object of the invention to provide a roof scaffolding system that has a pair of side rail assemblies adapted for supporting an elongated scaffold member.

It is a still further object of the invention to provide a roof scaffolding system that has a pair of elongated flexible members operationally connecting each side rail assembly to a peak anchor.

It is a still further object of the invention to provide a roof scaffolding system that has a cross rail and a net connectable between the side rail assemblies.

Accordingly, a roof scaffolding system of the type for use on a pitched roof that may be moved both longitudinally and laterally is provided. The roof scaffolding system includes: a peak anchor having a carrying assembly connected atop thereof, the peak anchor being adapted for connecting to a pitched roof; a side rail assembly having a base member, a top member and a load support member adapted to support an elongated scaffold member, the load support member interconnecting the base member and the top member; and an elongated flexible member operationally connecting the side rail assembly and the peak anchor in a manner such that the side rail assembly may be moved longitudinally and laterally upon a roof.

The peak anchor is connected to the roof to provide a means of supporting the side rail assembly on the roof. In a preferred embodiment the peak anchor is a V-shaped member for connecting atop the peak of a roof. The V-shaped peak anchor may be an articulate member whereby the angle may be adjusted so that the anchor may be used on various angled roof peaks. More preferably, the V-shaped anchor is articulate and may adjusted to a flat position for use on a substantially flat portion of a roof.

The peak anchor includes a carrying assembly for operationally connecting the side rail thereto via the elongated flexible member so that the side rail assemblies may be moved longitudinally and laterally upon the roof. The carrying assembly may be a rigid loop, an eyelet, a pulley assembly or a winch. In the case of a winch, each winch should be separately controllable. The side rail assemblies are moved by longitudinally by adjusting the distance from the peak anchors with the elongated flexible member. With the peak anchors to the roof at a distance greater the distance separating the side rail assemblies from one another, the side rail assemblies laterally.

The side rail assembly is preferably constructed of a lightweight, high strength metal. The base member may have a substantially flat lower surface so as to distribute the weight of the device reducing the damage to a shingled roof. Preferably, the lower surface has rounded edges to facilitate movement of the side rail assembly on the roof.

In a preferred embodiment, the side rail includes a plurality of load support members. The load support members are adapted for supporting the scaffolding members. Because roofs have varying pitches, the load supports may interconnect the base member and the top rail at various angles to accommodate the pitch of the roof upon which the system is being used. The side rail assembly may also include an adjustable clamp extending from the base member above and adjacent to each load support member. The adjustable clamp would be a mechanism such as one used in C-clamps.

The side rail assembly may further include a post having a bottom end and a top end, the bottom end being connected to a lower end of the side rail assembly. The post may be rigidly connected to the base member. Preferably the post is hingedly connected to the base member to provide a means of reducing the size of the system when being transported. When the post is hingedly connected, a brace is connected between the base member and the post to maintain the post in a stable, upright position.

A cross rail may be connected between the posts of the two side rail assemblies. The cross rail serves both as a safety rail for the user and to stabilize the side rail assemblies. In a preferred embodiment, the cross rail is adjustable in length so that various length scaffolding members may be used. The adjustable cross rail includes a first section forming a plurality of spaced holes therethrough and a second section forming a plurality of spaced holes therethrough slidably connected to the first section in a manner such that the holes formed by the first section and the holes formed by the second section may be aligned. A locking mechanism, such as a pin or bolt and nut, is provided for disposing through the aligned holes for maintaining the cross rail at a fixed length.

The roof scaffolding system may further include a net connectable between the posts of the two side rail assemblies. Preferably, the net is retractably held within a housing which is connected to a post of one of the side rail assemblies, the net having a first end connected to the post of the other side rail assembly. The net is retractably held within the housing by a mechanism such as a shaft and crank or a spring operated shaft well known in the art.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a perspective view of an exemplary embodiment of the roof scaffolding system of the present invention.

FIG. 2 is a perspective view of another exemplary embodiment of the roof scaffolding system of the present invention.

FIG. 3 is a front view of the peak anchor with a rigid loop as the carrying assembly.

EXEMPLARY MODE FOR CARRYING OUT THE INVENTION

FIG. 1 is a perspective view of an exemplary embodiment of the roof scaffolding system of the present invention generally designated by the numeral 10. Scaffolding system 10 includes a pair of peak anchors 12, a pair of side rail assemblies generally designated 14, a pair of elongated flexible members 16, a cross-rail generally designated 18 and at least one elongated scaffold member 20.

Peak anchor 12 is a V-shaped metal member adapted for connecting atop the peak P of a pitched roof R. Peak anchor 12 is connected to roof R by nails 30. A carrying assembly 32, such as a swivelly connected pulley assembly as shown, is connected atop peak anchor 12.

As shown, side rail assemblies 14 are installed on a pitched roof R in laterally spaced relation to one another. Side rail assembly 14 includes a base member 22, a top rail 24, load support members 26 and a post 28.

Base member 22 is adapted to lie substantially flat on roof R. Top rail 24 and base member 22 are interconnected by spaced load support members 26. Load supports 26 are adapted for supporting elongated scaffold member 20. Extending from base member 22 above each load support member 26 is an adjustable clamp 34 for securing elongated scaffold member 20 to load support member 26.

The bottom end 35 of post 28 is hingedly connected to the lower end 36 of base member 22 with a pin and clip fastening mechanism 38. Post 28 is maintained in a position substantially perpendicular to base member 22 by a brace 40 removably interconnected therebetween.

Cross rail 18 is connected between posts 28 of side rail assemblies 14 so as to maintain side rail assemblies 14 in a lateral spaced relationship and to provide a safety rail for a user (not shown). In this embodiment the length of cross rail 18 is adjustable so as to set the distance between side rail assemblies 14 to accommodate various sized elongated scaffold members 20.

Cross rail 18 includes a first section 48 slidably connected to a second section 50. First section 48 forms a plurality of spaced holes 52 completely therethrough. Second section 50 forms a plurality of spaced holes 54 completely therethrough. First section 48 is slidably inserted within second section 50 so that holes 52 and holes 54 may be aligned and a locking mechanism 56, such as a pin, may be disposed through aligned holes 52 and 54 maintaining cross rail 18 at a fixed length.

A peg 42 extends downwardly and perpendicularly from the distal ends of the first and second sections 48,50 of cross rail 18. Peg 42 is adapted for disposing within a bore 44 formed by the top end 46 of post 28 of side rail assembly 14, thereby interconnecting the side rail assemblies 14.

Elongated flexible member 16 is a cable or rope having a first end 58 and a second end 60. First end 58 of flexible cable 16 is secured to post 28 and flexible member 16 is attached to carrying assembly 32 and the second end 60 is connected to a cleat mounted on post 28 operationally connecting side rail assembly 14 with peak anchor 12. "Operationally connected" is defined to mean that by manipulating elongated flexible member 16 side rail assembly 14 may be moved longitudinally and/or laterally along roof R.

FIG. 2 is a perspective view of another exemplary embodiment of the roof scaffolding system of the present invention generally designated by the numeral 10. In this embodiment scaffolding system 10 further includes a net 64.

Net 64 is retractably held within a housing 66 by a shaft and spring mechanism (not shown) that is well known in the art. Housing 66 is connected to one of the posts 28 of the pair of side rail assemblies 14. Net 64 has a first end 68 connectable to the opposite post 28 of scaffolding system 10. First end 68 is connected to post 28 by a pair of hooks 70 extending from post 28. Net 64 is provided to catch small objects which may fall from roof R.

FIG. 3 is a front view of peak anchor 12. In this embodiment of peak anchor 12, carrying assembly 32 is a rigid loop.

It can be seen from the preceding description that a roof scaffolding system that may be moved longitudinally and laterally upon a roof which has a pair of peak anchors connectable approximate the peak of a roof each peak anchor having a carrying assembly, has a pair of side rail assemblies adapted for supporting an elongated scaffold member, has a pair of elongated flexible members operationally connecting each side rail assembly to a peak anchor, and has a cross rail and a net connectable between the side rail assemblies has been provided.

It is noted that the embodiment of the roof scaffolding system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A roof scaffolding system comprising:

a peak anchor having a carrying assembly connected atop thereof, said peak anchor being adapted for connecting to a pitched roof;

two side rail assemblies each having a base member, a top member, a load support member interconnecting said base member and said top member and a post connected to a lower end of said base member, said load support member being adapted to support an elongated scaffold member;

a cross rail connected to a said post of each of said two side rail assemblies;

an elongated flexible member operationally connecting one of said two side rail assemblies and said peak anchor in a manner such that said one of said two side rail assemblies is moveable longitudinally and laterally upon a roof;

a housing connected to a said post of one of said two side rail assemblies;

a net retractably held within said housing having a first end connectable to said post of another said side rail assembly; and an adjustable clamp extending from said base member of said one of said two side rail assemblies above said load support member for securing said elongated scaffold member to said load support member;

said cross rail including: a first section forming a plurality of spaced holes therethrough, a second section forming a plurality of spaced holes therethrough slidably connected to said first section in a manner such that said holes formed by said first section and said holes formed by said second section may be aligned, and a locking mechanism for disposing through said aligned holes for maintaining said cross rail at a fixed length.

2. A roof scaffolding system comprising:

a peak anchor having a carrying assembly connected atop thereof, said peak anchor being adapted for connecting to a pitched roof;

two side rail assemblies each having a base member, a top member, a load support member interconnecting said base member and said top member and a post connected to a lower end of said base member, said load support member being adapted to support an elongated scaffold member;

an adjustable clamp extending from said base member of each of said two side rail assemblies above said load support member for securing said elongated scaffold member to said load support member;

a cross rail connected between posts of said two side rail assemblies;

a net connectable between posts of said two side rail assemblies; and an elongated flexible member operationally connecting one of said two side rail assemblies and said peak anchor in a manner such that said one of said two side rail assemblies is moveable longitudinally and laterally upon a roof.

* * * * *

UNITED STATES PATENT AND TRADEMARK OFFICE

CERTIFICATE OF CORRECTION

PATENT NO. : 5,862,880

DATED : January 26, 1999

INVENTOR(S) : Nelson et al.

It is certified that error appears in the above-identified patent and that said Letters Patent is hereby corrected as shown below:

On the title page, item [76] replace (Sharon L. Niles) with --Sharon L. Nelson--

Signed and Sealed this

Twenty-third Day of January, 2001

*Attest:*

*Attesting Officer*

Q. TODD DICKINSON

*Commissioner of Patents and Trademarks*